United States Patent [19]

Feldsted

[11] Patent Number: 4,915,712

[45] Date of Patent: Apr. 10, 1990

[54] EVAPORATIVE GAS COOLING SYSTEM AND METHOD

[75] Inventor: Robert J. C. Feldsted, Seattle, Wash.

[73] Assignee: Aerequipment Engineers, Inc., Woodinville, Wash.

[21] Appl. No.: 228,980

[22] Filed: Aug. 5, 1988

Related U.S. Application Data

[62] Division of Ser. No. 46,935, May 5, 1987, abandoned.

[51] Int. Cl.[4] ..... B01F 3/04

[52] U.S. Cl. ..... 55/84; 55/224; 55/236; 55/260; 261/116; 261/79.2; 261/17; 261/DIG. 9

[58] Field of Search ..... 55/224, 236, 238, 260, 55/84; 261/DIG. 54, 116, 79.2, 17, DIG. 9

[56] References Cited

U.S. PATENT DOCUMENTS

| | | | |
|---|---|---|---|
| 895,790 | 8/1908 | Richards | 261/116 |
| 996,217 | 6/1911 | Cramer et al. | 55/224 |
| 2,984,468 | 5/1961 | Kuhner | 261/116 |
| 3,442,232 | 5/1969 | White | 55/236 |
| 3,490,204 | 1/1970 | Kalika | 261/DIG. 54 |
| 3,618,299 | 11/1971 | Vincent | 55/236 |
| 3,664,818 | 5/1972 | Kramer | 261/DIG. 54 |
| 3,761,065 | 9/1973 | Rich et al. | 261/DIG. 54 |
| 3,811,278 | 5/1974 | Taylor et al. | 261/79.2 |
| 3,842,615 | 10/1974 | Reigel et al. | 261/116 |
| 3,868,936 | 3/1975 | Rivere | 261/116 |
| 4,057,602 | 11/1977 | Kolm | 55/224 |
| 4,293,524 | 10/1981 | Teller et al. | 55/236 |
| 4,320,092 | 3/1982 | Kondo et al. | 261/DIG. 54 |
| 4,358,289 | 11/1982 | Austin | 55/224 |

FOREIGN PATENT DOCUMENTS

| | | | |
|---|---|---|---|
| 587162 | 1/1959 | Italy | 261/116 |
| 166243 | 2/1959 | Sweden | 55/236 |
| 992902 | 1/1983 | U.S.S.R. | 261/116 |
| 1318265 | 6/1987 | U.S.S.R. | 55/260 |

*Primary Examiner*—Tim Miles

*Attorney, Agent, or Firm*—Seed and Berry

[57] ABSTRACT

An evaporative gas cooling system in which a hot gas stream is divided into two portions before flowing downwardly through a cooling tower. One portion of the gas stream flows into the center of the cooling tower through water droplets generated by atomizing nozzles. Another portion of the gas stream flows downwardly along the inner sidewall of the cooling tower to form a protective barrier, thereby preventing the water droplets from collecting on the wall of the cooling tower. In one embodiment, the gas stream is divided into two portions by a deflector dome having a converging lower sidewall surrounded by a converging frustoconical guide plate. In a second embodiment, the gas stream is divided into two portions by an inner frustoconical conduit mounted within an outer frustoconical shell.

18 Claims, 3 Drawing Sheets

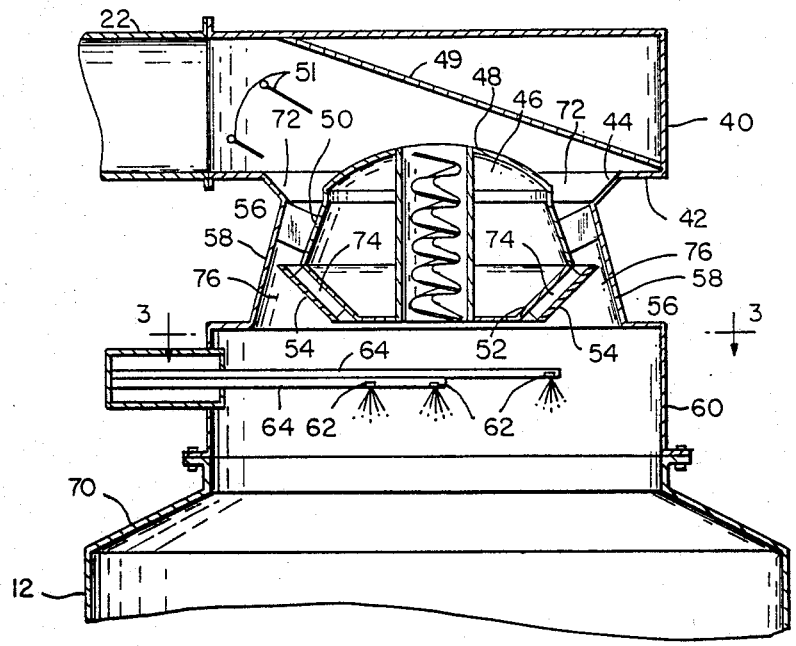
FIG. 2
FIG. 3
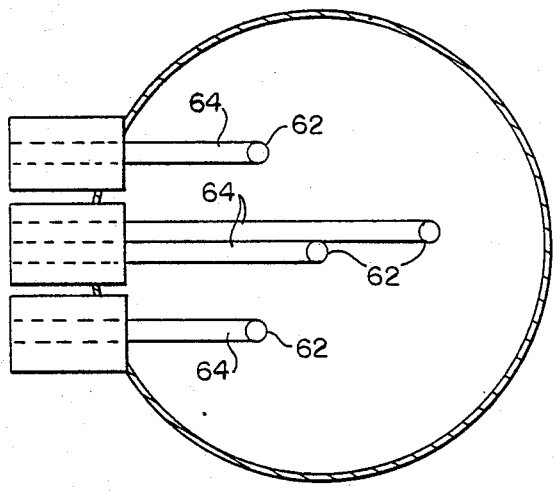
FIG. 4
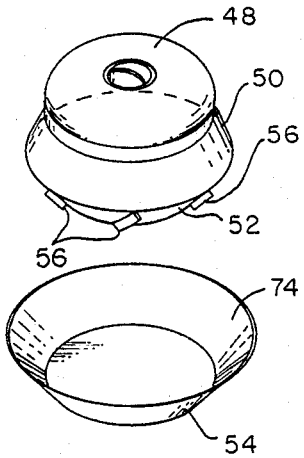

EVAPORATIVE GAS COOLING SYSTEM AND METHOD

DESCRIPTION

This application is a divisional of U.S. patent application Ser. No. 046,935 filed May 5, 1987, now abandoned.

1. Technical Field

This invention relates to evaporative gas cooling systems, and more particularly, to a gas flow control structure for evaporative gas cooling systems to restrict cooling fluid from collecting on cooling towers employed in such systems.

2. Background Art

Evaporative gas cooling systems have long been used to reduce the temperature of hot gases generated by various power generating and industrial processes. Evaporative gas cooling makes use of the scientific principle that heat is required to change water from a liquid to a gaseous (vaporous) state. In evaporative gas cooling systems, water is sprayed into a hot gas stream. The heat from the gas is transferred to the water spray, thereby transforming the water into a vapor. The heat transferred from the gas to the water lowers the temperature of the gas. If desired, the gas inlet or outlet temperature can be monitored to control the quantity of water sprayed into the gas stream or the flow rate of the gas stream.

Evaporative gas cooling systems exhibit a number of advantages. Since the volume of the gas is directly proportional to its temperature, cooling a hot gas stream reduces the volume and hence flow rate of the gas stream. For example, reducing the temperature of the gas stream from 800° F. to 250° F. reduces the volume of the gas stream to 56% of its original value. Thus, the capacity of downstream gas handling or processing equipment can be reduced. For example, hot gases often contain particulate matter that must be removed by filters, such as baghouses, or electrostatic precipitators. By cooling the gas before downstream processing, the capacity of the baghouse or electrostatic precipitator can be reduced. Furthermore, cooler exhaust gases usually permit less expensive materials to be used in the downstream processing equipment. For example, in a baghouse, evaporative cooling eliminates the need for high-temperature filter bags, leading to considerable savings in filter media and maintenance costs. In the past, relatively inexpensive, low-temperature processing equipment could receive high-temperature gas streams only by diluting the high-temperature gas stream with ambient air. However, adding ambient air to the high-temperature gas stream greatly increases the volume of the gas stream, thus unduly increasing the required capacity of the downstream processing equipment.

Although evaporative gas cooling systems provide advantageous results in a wide variety of circumstances, they nevertheless suffer from limitations. One problem with conventional evaporative gas cooling systems is the corrosive effect of the water sprayed into the gas stream when all of the water does not vaporize. Under these circumstances, water collects in the bottom of a cooling tower and in dowstream equipment, thus corroding the tower and other equipment. The corrosion problem is particularly severe in many applications because of the chemical composition of the gas. The water collected in the bottom of the cooling tower or downstream equipment often becomes acidic because of chemicals absorbed from the gas stream. The acidic water can quickly corrode the cooling tower and downstream equipment.

The corrosive effects of incomplete vaporization of cooling water in evaporative gas cooling systems have been recognized. This problem has generally been dealt with by attempting to minimize the size of the water droplets in the spray since finer water droplets can evaporate significantly faster than larger droplets. Additionally, complete evaporation is promoted by producing turbulent flow conditions in the cooling tower in order to increase the effective length of the cooling tower.

Although the above-described attempts to solve the problem of water collecting in the cooling tower and downstream equipment have met with some success, water nevertheless often collects on the inside wall of evaporative gas cooling towers. The water then flows downwardly along the wall of the cooling tower, where it produces corrosion of the cooling tower and downstream equipment.

DISCLOSURE OF THE INVENTION

It is an object of the invention to provide an evaporative gas cooling system that promotes complete vaporization of cooling water.

It is another object of the invention to provide an evaporative gas cooling system that prevents the corrosive effects of cooling water collected downstream from the cooling water spray nozzles.

It is still another object of the invention to provide an evaporative gas cooling system having a gas discharge nozzle that promotes even flow of the gas through the evaporative gas cooling tower.

These and other objects of the invention are provided by an evaporative gas cooling system having an elongated cylindrical cooling tower positioned vertically, with the gas stream flowing upwardly or downwardly. An atomizing nozzle is mounted in the upstream end of the cooling tower. The atomizing nozzle generates fine droplets of a cooling liquid. The gas stream flows into the cooling tower through a gas discharge nozzle having a central inner passage directing a portion of the gas stream toward the atomizing nozzle so that the droplets of cooling fluid mix with the gas stream.

The gas discharge nozzle also includes an annular outer passage through which a portion of the gas stream flows outwardly along the inner wall of the cooling tower. The gas flowing along the inner wall of the cooling tower produces a protective layer of hot gas that prevents the water droplets from reaching the wall of the cooling tower. Further, when the gas stream is cooled at the center of the cooling tower, the gases contract, thereby causing the hot gas flowing along the wall of the cooling tower to flow inwardly to mix with the cooled gas. This inward flow of the hot gases further restricts the water droplets from reaching the wall of the cooling tower. The atomizing nozzle may be positioned either below or within the gas discharge duct.

In one embodiment, the gas discharge duct includes an outer frustoconical shell extending outwardly toward the cooling tower. A generally cylindrical deflector dome is positioned within the shell along the longitudinal axis of the cooling tower. The deflector dome has an outer surface extending inwardly toward the atomizing nozzle. A frustoconical guide ring extends inwardly toward the nozzle between the inwardly extending outer surface of the deflector dome and the shell. The guide ring divides the area between the shell and the deflector dome into an annular outer passage and a central inner passage.

The evaporative gas cooling system may further include a plenum housing positioned upstream from the gas discharge duct. The plenum housing receives gas at a relatively high pressure so that a pressure differential is generated across the inner and outer passages of the gas discharge duct in order to promote even flow through the duct. The plenum housing may include a divider plate to reduce the cross-sectional area of the plenum away from the inlet in order to maintain a constant flow velocity in the plenum. Deflector vanes may also be used to deflect the incoming air into the gas discharge duct.

In another embodiment, the gas discharge duct includes an outer frustoconical shell extending outwardly toward the cooling tower. An inner frustoconical conduit is positioned within the shell to form the inner passage through the conduit and the outer passage between the conduit and shell. An inwardly projecting ring may be mounted on the wall of the cooling tower adjacent the downstream edge of the frustoconical conduit. The inwardly projecting ring deflects the gas stream flowing through the outer passage inwardly away from the wall of the cooling tower in order to further restrict gas droplets from reaching the wall of the cooling tower.

BRIEF DESCRIPTION OF THE DRAWINGS

FIG. 2 is a cross-sectional view of one embodiment of the inventive evaporative gas cooling system.

FIG. 3 is a cross-sectional view taken along the line 3—3 of FIG. 2.

FIG. 4 is an exploded isometric view of a portion of the discharge nozzle used in the embodiments of FIGS. 2 and 3.

BEST MODE FOR CARRYING OUT THE INVENTION

Figure 1:
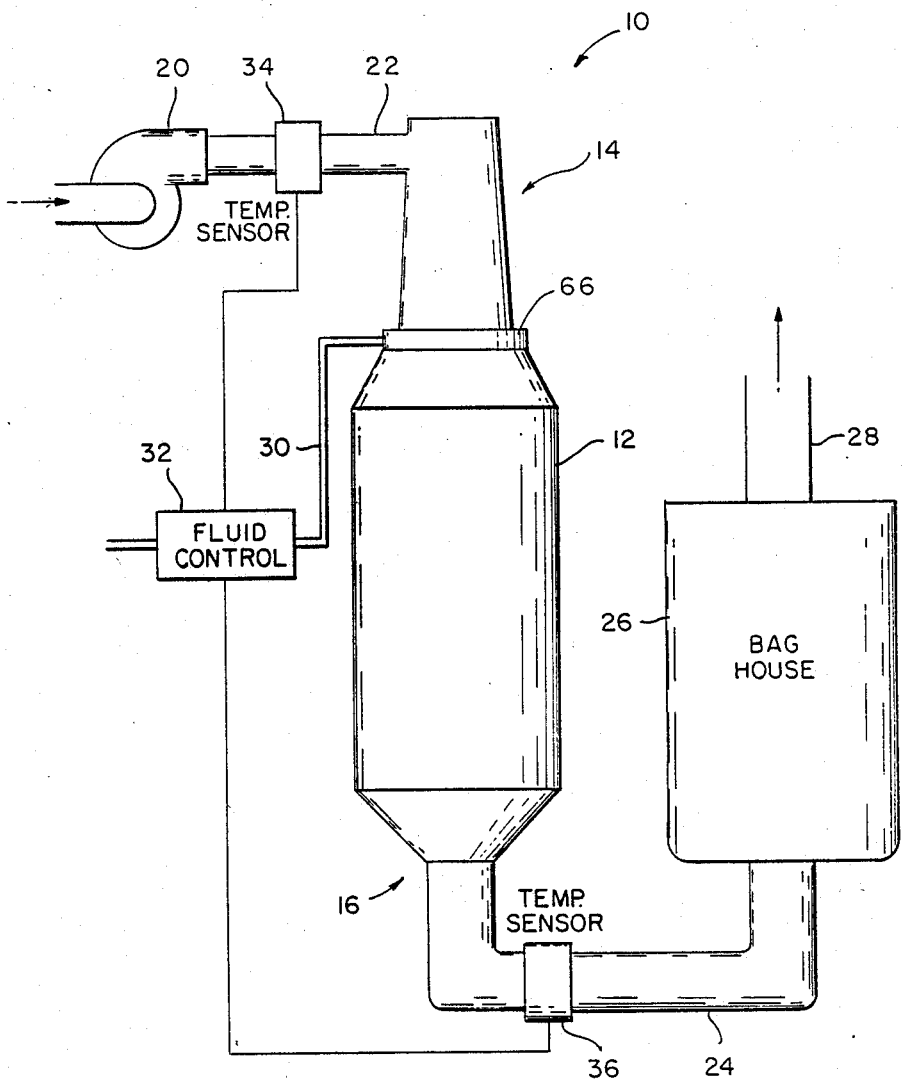
FIG. 1 is a schematic of the inventive evaporative gas cooling system.

The inventive gas cooling system 10, as illustrated in FIG. 1, utilizes a generally cylindrical cooling tower 12 of conventional design. The cooling tower 12 is disposed in a vertical configuration, and, as explained below in greater detail, a gas stream flows downwardly from an inlet 14 at its upper end to an outlet 16 at its lower end. The hot gas may be directed into the cooling tower 12 by a conventional fan 20 having its outlet connected to the cooling tower 12 through a conduit 22. Similarly, a conduit 24 may connect the outlet 16 of the cooling tower 12 with such gas processing equipment as a baghouse 26 of conventional design. Relatively cool, clean air is then discharged by the baghouse through conduit 28.

In order to reduce the temperature of the gas stream to a controlled level, water is directed through pipe 30 to a plurality of atomizing nozzles (not shown) inside the cooling tower 12. The flow of the cooling water is controlled by a conventional fluid control device 32. The fluid control device 32 receives outputs from conventional temperature sensors 34, 36 mounted in the inlet conduit 22 and outlet conduit 24, respectively. The fluid control 32 adjusts the rate at which the water flows through the pipe 30 and internal atomizing nozzles in order to maintain the temperature of the gas stream in the outlet conduit 24 relatively constant. The temperature of the gas stream entering the cooling tower 12 through the inlet conduit 22 is measured to obtain an approximate indication of the degree of cooling that will be required, depending upon the temperature of the incoming gas stream. The cooling tower 12 is preferably lined with an insulating material to prevent the moist gases produced by evaporation from condensing on the inner walls of the tower 12.

Although the gas is described in FIG. 1 as flowing downwardly through the cooling tower 12, it will be understood that the equipment shown in FIG. 1 can be modified so that the gas flows upwardly from bottom to top of the cooling tower 12.

As discussed above, the water sprayed in conventional cooling towers often collects at the bottom of the cooling tower or in downstream processing equipment, such as a baghouse 26. This water has a tendency to corrode the cooling tower 12 or baghouse 26, particularly when the chemical composition of the gas stream transforms the water into an acid.

One embodiment of an inventive evaporative gas cooling system that promotes complete vaporization of the water spray is illustrated in FIG. 2. Incoming gas through inlet conduit 22 enters a plenum housing 40. The plenum housing 40 includes a bottom 42 having a circular cutout 44. The circular cutout 44 receives the upper end of a deflector dome 46. The deflector dome 46 has a curved upper surface 48, an outwardly flaring outer sidewall 50, and an inwardly flaring lower sidewall 52. A divider plate 49 extending across the inside of the plenum housing 40 maintains the flow velocity through the plenum housing 40 constant. The divider plate 49 performs this function by reducing the cross-sectional area of the plenum housing 40 in accordance with the reduction in the volume of gas flow through the housing 49 as the gas is diverted downwardly as it flows through the housing 49. A pair of delfector vanes 51 extending across the plenum housing 40 may be used to direct the gas flow downwardly from the plenum housing 40.

A cylindrical conduit 53 extends through the center of the deflector dome to ensure a high percentage of high velocity gas flow along the center of the cooling tower 12 to promote mixing as described below. The gas flowing through the conduit 53 also prevents gas from mixing with water and then flowing backwardly to wet the cooling structure as explained in greater detail below. Spiral vanes 55 may be mounted in the cylindrical conduit 53 to further promote turbulent flow gas/water mixing.

A conical guide ring 54 is mounted adjacent the lower sidewall 52 of the deflector dome 46 and is secured thereto by spiral fins 56, as best illustrated in FIG. 4. The spiral fins 56 may be spiraled in the opposite direction from the fins 53 in the conduit 51 in order to further promote turbulent flow mixing. The deflector dome 46 and guide ring 54 are mounted in a frustoconical shell 58 extending from the plenum chamber 40 to the upper end of a spray housing 60.

The spray housing 60 encloses a plurality of atomizing nozzles 62 mounted at the ends of respective conduits 64, as also illustrated in FIG. 3. The atomizing nozzles 62 are a dual fluid type (water and compressed air) and are commercially available from Delavan of Louisville, Ky. The spray housing 60 is mounted at the upper end of the conventional cooling tower 12. As illustrated in FIG. 2, the cooling tower 12 has a frustoconical transition piece 70 and cylindrical sidewalls 12.

In operation, the gas stream flows into the plenum housing 40 through the inlet conduit 22. A portion of the gas stream then flows through the cylindrical conduit 51 while the remainder of the gas stream flows through inlet 72. The gas stream flowing through inlet 72 is divided into an inner stream flowing through an inner passage 74 and an outer stream flowing through an annular outer passage 76. As illustrated in FIG. 2, the inner passage 74 is formed between the lower sidewall of the deflector dome 46 and the guide plate 54. The annular outer passage is formed between the guide ring 54 and shell 58.

The gas stream flowing through the cylindrical conduit 51 and the gas stream flowing through the inner passage 74 is directed toward the atomizing nozzles 62. These gas streams then collide in the area in which the water droplets are sprayed, thereby causing turbulent flow conditions. The gas stream flowing through the cylindrical conduit 53 prevents gas flowing through the inner passage 74 from mixing with water from the spray nozzles 62 and then flowing backwardly in the turbulent flow to wet the structure above the nozzles 62. The turbulent flow conditions increase the effective residence time of the gas in the cooling tower 12. This increase in the residence time in the cooling tower 12 has the effect of increasing the length of the cooling tower 12. To maximize the turbulent flow of the inner gas stream it is highly desirable to use the vanes 56 to impart a swirling motion to the inner gas stream.

It is intuitively apparent that the turbulent flow of the inner gas stream directed at the droplets would have the effect of impelling some of the droplets to the sidewall of the cooling tower 12. The droplets would then collect on the sidewall of the cooling tower 12 and flow downwardly to the bottom of the cooling tower 12 and downstream processing equipment.

In order to prevent the droplets from reaching the sidewall of the cooling tower 12, the outer gas stream flowing through outer passage 76 flows downwardly along the side of the spray housing and sidewall of the cooling tower 12. This hot, annular gas stream flowing downwardly along the sidewall of the cooling tower 12 forms a protective layer to prevent the water droplets from contacting the sidwall of the tower 12. The water droplets, in order to reach the sidewall of the cooling tower 12, would have to pass through the hot gases without evaporation. However, since the gas stream flowing through the outer passage 76 is not cooled significantly prior to reaching the cooling tower 12, the gas stream quickly evaporates any water droplets before they progress through the protective layer any substantial distance.

The flow rate and pressure of the gas stream entering the plenum housing 40 are sufficiently high so that a pressure differential is generated across the inner passage 74 and outer passage 76. This pressure differential is caused by the deflector dome 46 acting as a flow restrictor. The pressure differential across the passages 74, 76 causes an increase in the velocity of the gas flowing through the passages 74, 76 and promotes the uniform flow of the gas stream around the circumference of the passages 74, 76. The divider plate 49 further ensures uniform flow through the passages 74, 76 by maintaining a uniform flow velocity through the plenum housing 40. The deflector vanes 51 overcome the momentum of the gas stream to maintain flow through the passages 74, 76 near the inlet 22.

Water droplets are also restricted from reaching the sidewall of the cooling tower 12 by the flow characteristics of the annular gas stream flowing along the sidewall of the cooling tower 12. As the inner and outer gas streams flow downwardly through the cooling tower 12, cooling occurs at the center of the gas stream, where the water droplets are generated by the atomizing nozzles 62. When the gas at the center of the cooling tower 12 is cooled, the gas contracts, thus causing the gas stream at the outer portions of the cooling tower 12 to flow inwardly toward the cooled area. The inward flow of the hot gases toward the cooler gases further has the tendency of preventing the water droplets from flowing outwardly toward the wall of the cooling tower 12. As the gas stream progresses further down the cooling tower 12, cooling of the gas stream continues from the inside toward the outside. The cooling of the gas stream from the inside toward the outside continues to cause the gas stream to contract at the center, thereby continuing the inward flow of the hot gas stream toward the cooler gas stream at the center of the cooling tower.

Although the embodiment of FIGS. 1–4 is shown with the air flowing downwardly through the cooling tower 12, it will be understood that the cooling system can operate in reverse order. In other words, the deflector dome 46 may be mounted upside down beneath the spray housing 60 at the bottom of the cooling tower 12. The gas stream would then flow upwardly through the cooling tower. This configuration has the advantage of increasing the evaporization of the water droplets in the gas stream since gravity causes the droplets to flow against the upwardly flowing gas stream.

Figure 5:
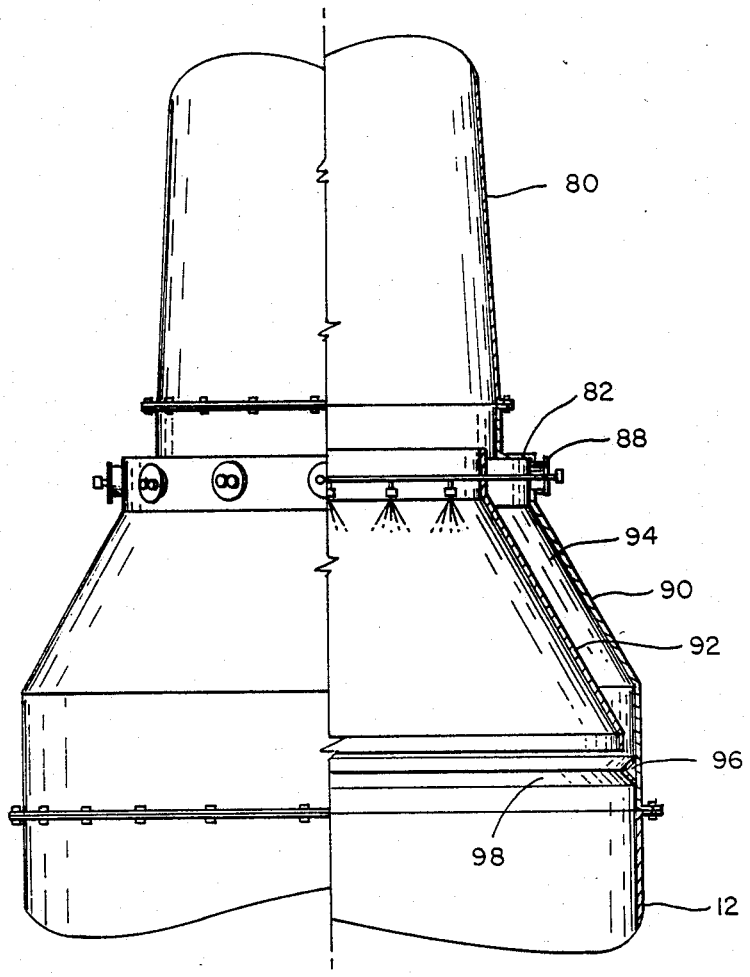
FIG. 5 is a cross-sectional view of another embodiment of the inventive evaporative gas cooling system.

With reference now to FIG. 5, another embodiment of an evaporative gas cooling system utilizes a gas discharge nozzle of a somewhat different design to generate an annular gas stream flowing along the wall of the cooling tower 12 to provide a protective layer. In the embodiment of FIG. 5, the gas stream flows downwardly through an inlet conduit 80 to a relatively short spray housing 82. The spray housing contains a plurality of atomizing nozzles 84 of the type utilized in the embodiment of FIGS. 2–4. The atomizing nozzles 84 receive cooling water through respective tubular conduits and communicate with a common manifold 88 extending around the circumference of the spray housing 82.

The spray housing 82 is mounted at the upper end of a frustoconical transition piece 90 that extends downwardly to the sidewall of the cooling tower 12. An inner frustoconical conduit 92 is positioned within the transition piece or shell 90. The gas stream flowing through the inlet conduit 80 is, as with the embodiment of FIGS. 2–4, divided into two portions. An inner stream flows through the water droplets generated by the atomizing nozzles 84 and through the inside of the frustoconical conduit 92. This inner gas stream mixes with the water droplets to evaporate the water droplets and cool the inner gas stream. An annular outer gas stream flows through a passage 94 formed between the frustoconical conduit 92 and transition piece 90. The gas flowing through this outer passage 94 flows downwardly along the sidewall of the cooling tower 12 to form a protective layer of hot gas. The protective layer of hot gas prevents the water droplets from reaching the sidewall of the cooling tower 12 in the manner described above with reference to the embodiment of FIGS. 2–4. An annular deflector ring 96 having an inwardly directed peripheral lip 98 may be mounted on the inside of the cooling tower 12 to further direct the outer gas stream inwardly in order to further lessen the probability that water droplets will reach the sidewall of the cooling tower 12.

It is thus seen that the inventive evaporative gas cooling system provides complete vaporization of the cooling water droplets and prevents the water droplets from collecting on the sidewall of the cooling tower 12. Corrosion of the cooling tower 12 and downstream processing equipment is prevented in a manner that is relatively simple and inexpensive.

I claim:

1. A method of evaporatively cooling a gas stream, comprising:

dividing said gas stream into an inner gas stream flowing along the center axis of a cooling tower in a swirling manner toward one end of said cooling tower, and an outer gas stream surrounding said inner gas stream and flowing axially through said cooling tower, said outer gas stream forming a substantially continuous barrier between said inner gas stream and the wall of said cooling tower; and spraying droplets of a cooling fluid into said inner gas stream downstream from where said gas stream is divided into inner and outer gas streams so that the substantially continuous barrier formed by said outer gas stream restricts said droplets from contacting the wall of said cooling tower, wherein further including the step of directing said inner gas stream in a radially inward direction to promote mixing between said inner gas stream and said droplets and to restrict said droplets from contacting the wall of said cooling tower.

2. A system for evaporatively cooling a hot gas stream, comprising:

an elongated cooling tower having said gas stream flowing therethrough;

an atomizing nozzle mounted in said cooling tower toward the upstream end thereof, said nozzle generating fine droplets of a cooling fluid;

an outer frustoconical shell extending outwardly toward said cooling tower in the downstream direction;

a generally cylindrical deflector dome positioned within said shell along the longitudinal axis of said cooling tower, said deflector dome having an outer surface extending inwardly toward said nozzle in said downstream direction; and a frustoconical guide ring extending inwardly toward said atomizing nozzle in the downstream direction, said guide ring being mounted between the inwardly extending outer surface of said deflector dome and said shell, said guide ring forming an outer passage between said guide ring and shell directing a portion of said gas stream outwardly along the inner wall of said cooling tower, said guide ring and deflector dome forming an inner passage therebetween directing a portion of said gas stream toward said atomizing nozzle so that said droplets of cooling fluid mix with said gas stream, whereby said gas stream flowing from said outer passage along the inner wall of said cooling tower prevents said droplets from collecting on the inner wall of said cooling tower.

3. The evaporative gas cooling system of claim 2, further including flow control means for directing the cooling fluid to said atomizing nozzle as a function of a flow control signal, and gas conveying means directing a gas to be cooled through said cooling tower.

4. The evaporative gas cooling system of claim 2 wherein said inwardly extending surface of said deflector dome is parallel to said guide ring so that the width of said inner passage is constant along the length of said passage.

5. The evaporative gas cooling system of claim 2 further including a cylindrical conduit extending through said deflector dome along the central axis thereof to convey said gas stream to said atomizing nozzle along the central axis of said cooling tower.

6. The evaporative gas cooling system of claim 5 further includng a spiral vane mounted on the inside wall of said cylindrical conduit to cause turbulent flow of the gas stream flowing through said cylindrical conduit when said gas stream contacts the portion of said gas stream flowing through said inner passage.

7. The evaporative gas cooling system of claim 6 further including a plurality of circumferentially spaced deflector vanes extending between said deflector dome and guide ring, said deflector vanes being angled in the opposite direction from the spiral vane in said cylindrical conduit so that the portion of said gas stream flowing through said conduit swirls in the opposite direction from the portion of said gas stream flowing through said inner passage thereby promoting turbulent flow conditions.

8. The evaporative gas cooling system of claim 2, further including a plenum housing positioned upstream said deflector dome and shell, said housing including a plate having a circular cutout receiving said deflector dome, said cutout having a diameter that is larger than the diameter of said deflector dome, thereby forming an outlet for said plenum housing between said deflector dome and the edge of said cutout, whereby said plenum housing forms a plenum communicating with said inner and outer passages.

9. The evaporative gas cooling system of claim 8 further including a divider plate mounted in said plenum housing to reduce the cross-sectional area of said plenum in the direction of gas flow thereby maintaining the gas flow velocity in said plenum relatively constant.

10. The evaporative gas cooling system of claim 8 further including a deflector vane extending across said plenum housing perpendicular to the direction of gas flow, said deflector vane being positioned adjacent the inlet of said plenum to deflect said gas stream into said passages.

11. The evaporative gas cooling system of claim 2, further including a plurality of circumferentially spaced vanes extending between said deflector dome and guide ring.

12. The evaporative gas cooling system of claim 11 wherein said vanes are angled in a circumferential direction to impart a rotational swirl to the portion of said gas stream flowing through said inner passage.

13. A gas discharge nozzle adapted for use with a cylindrical cooling tower having an atomizing nozzle generating droplets of cooling fluid at its upstream end, said discharge nozzle comprising:

an outer frustoconical shell extending outwardly in a first direction along a central axis of said shell;

a generally cylindrical deflector dome positioned within said shell along the central axis thereof, said deflector dome having an outer surface extending inwardly in said first direction along the central axis of said shell;

a frustoconical guide ring extending inwardly in said first direction along the central axis of said shell, said guide ring being mounted between the inwardly extending outer surface of said deflector dome and said shell, said guide ring forming an outer passage between said guide ring and shell and an inner passage between said guide ring and deflector dome.

14. The gas discharge nozzle of claim 13, further including a plurality of circumferentially spaced vanes extending between said deflector dome and guide ring, said vanes being angled in a circumferential direction to impart a rotational swirl to the portion of said gas stream flowing through said inner passage.

15. The gas discharge nozzle of claim 13, further including a plenum housing positioned in the direction opposite said first direction from said deflector dome and shell, said housing including a plate having a circular cutout receiving said deflector dome, said cutout having a diameter that is larger than the diameter of said deflector dome, thereby forming an outlet for said plenum housing between said deflector dome and the edge of said cutout, whereby said plenum housing forms a plenum communicating with said inner and outer passages.

16. The evaporative gas cooling system of claim 15 further including a divider plate mounted in said plenum housing to reduce the cross-sectional area of said plenum in the direction of gas flow thereby maintaining the gas flow velocity in said plenum relatively constant, said system further including a deflector vane extending across said plenum housing perpendicular to the direction of gas flow, said deflector vane being positioned adjacent the inlet of said plenum to deflect said gas stream into said passages.

17. The gas discharge nozzle of claim 13 further including a cylindrical conduit extending through said deflector dome along the central axis thereof to convey said gas stream to said atomizing nozzle along the central axis of said cooling tower.

18. The gas discharge nozzle of claim 17 further including a spiral vane mounted on the inside wall of said cylindrical conduit to cause turbulent flow of the gas stream flowing through said cylindrical conduit when said cooling fluid contacts the portion of said gas stream flowing through said inner passage, said nozzle further including a plurality of circumferentially spaced deflector vanes extending between said deflector dome and guide ring, said deflector vanes being angled in the opposite direction from the spiral vane in said cylindrical conduit so that the portion of said gas stream flowing through said conduit swirls in the opposite direction from the portion of said gas stream flowing through said inner passage thereby promoting turbulent flow conditions.

* * * * *